US005905930A

United States Patent [19]

Toyama et al.

[11] Patent Number: 5,905,930

[45] Date of Patent: May 18, 1999

[54] IMAGE FORMING APPARATUS

[75] Inventors: Toshimasa Toyama; Toshio Hino; Yoshihiro Tonomoto; Masaaki Ohyama; Naoto Hirao; Yoshinori Wada; Mituaki Ono, all of Kawasaki; Kiyoshi Chinzei; Katsumi Adachi, both of Kato-gun, all of Japan

[73] Assignee: Fujitsu Limited, Kawasaki, Japan

[21] Appl. No.: 08/938,934

[22] Filed: Oct. 2, 1997

[30] Foreign Application Priority Data

Mar. 19, 1997 [JP] Japan ..... 9-066909

[51] Int. Cl.[6] ..... G03G 15/01

[52] U.S. Cl. ..... 399/299; 399/384

[58] Field of Search ..... 399/66, 75, 297, 399/298, 299, 300, 306, 316, 317, 318, 310, 384

[56] References Cited

U.S. PATENT DOCUMENTS

| | | | |
|---|---|---|---|
| 4,958,187 | 9/1990 | Tsuchiya et al. | 399/306 |
| 5,172,180 | 12/1992 | Ohshima et al. | 399/75 |
| 5,365,324 | 11/1994 | Gu et al. | 399/299 |
| 5,450,164 | 9/1995 | Negishi et al. | 399/384 X |

FOREIGN PATENT DOCUMENTS

| | | |
|---|---|---|
| 57-63559 | 4/1982 | Japan . |
| 7-77851 | 3/1995 | Japan . |
| 7-237336 | 9/1995 | Japan . |

*Primary Examiner*—Sandra Brase
*Attorney, Agent, or Firm*—Armstrong, Westerman, Hattori, McLeland, & Naughton

[57] ABSTRACT

An image forming apparatus includes a plurality of process units contacting a continuous recording medium and transferring images on the recording medium, a separating and contacting mechanism for controlling at least one of the recording medium and each of the process units to a separated state where the recording medium and the process unit are separated from each other and a contacting state where the recording medium and the process unit contact each other, and a controller for controlling the separating and contacting mechanism at a position where the process unit confronts a non-printing region on the recording medium so as to put the recording medium and the process unit to the contacting state.

14 Claims, 14 Drawing Sheets

IMAGE FORMING APPARATUS

BACKGROUND OF THE INVENTION

The present invention generally relates to image forming apparatuses, and more particularly to an image forming apparatus which is provided with a plurality of process units which record images on a recording medium such as a continuous recording paper using the electrophotography technique.

When recording images on both sides of the recording paper using a single process unit, the recording paper is turned over after recording the image on a first side of the recording paper, and the image is thereafter recorded on a second side of the recording paper. For this reason, there is a limit to increasing the image recording speed, and a method has been proposed to use two process units for respectively recording the images on the first and second sides of the recording paper.

On the other hand, when recording a color image, there is a method which uses a single process unit. In this case, the single process unit is used to successively record images of each of the colors such as yellow, magenta, cyan and black on the recording paper in an overlapping manner, and there is also a limit to increasing the image recording speed. Hence, a method has been proposed to provide a plurality of process units, and to record the image of each color using one of the process units.

Conventionally, in a printer which uses the electrophotography technique and records the image on the continuous recording paper, if one print operation (job) ends and a next job does not occur for a predetermined time, a portion of the paper printed with the last line remains within a paper transport path within the printer. Accordingly, the recording paper is fed forward manually or automatically so as to eject the portion of the paper printed with the last line outside the printer, so that the recording paper can be cut along a perforation provided subsequent to the portion of the paper printed with the last line.

However, when the next job is started in this state, the printing is started in a state where the amount of recording paper which is fed forward to remove the print result of the previous job precedes the first line of this next job. As a result, the amount of the recording paper which is fed forward is wasted, and the utilization efficiency of the recording paper is poor.

Accordingly, a so-called back-feed is conventionally carried out if one job ends and the next job does not occur for a predetermined time. This back-feed feeds the recording paper forward if one job ends but the next job does not occur for the predetermined time, and returns the recording paper by a predetermined amount before the next job starts. As a result, the utilization efficiency of the recording paper is improved. A photoconductive body of the process unit and the recording paper are separated from each other when carrying out the back-feed.

Similarly, in the case of the printer which successively records images by the first and second process units, for example, the last line that is recorded is located on a downstream side of the second process unit in a transport direction of the recording paper at a point in time when one job ends. Hence, if the next job starts in this state, the portion of the paper between the first and second process units is wasted. For this reason, a method has been proposed to also carry out the back-feed described above in such a case.

However, in the case of the printer which successively records the images by the first and second process units, if a single fixing unit is used to simplify the printer construction, this fixing unit is provided on the downstream side of the second process unit which is provided on the most downstream side along the transport direction of the recording paper. Consequently, when the above described back-feed is carried out, the image recorded on the recording paper by the previous job is not yet fixed. Therefore, when the photoconductive body of each process unit and the recording paper make contact at the start of the next job, there was a problem in that the image which is not yet fixed may be disturbed by the shock of the contact between the photoconductive body and the recording paper. If the image which is not yet fixed is disturbed, the image recording quality greatly deteriorates and it becomes necessary to carry out the two jobs over again, thereby introducing another problem in that the performance of the printer greatly deteriorates.

SUMMARY OF THE INVENTION

Accordingly, it is a general object of the present invention to provide a novel and useful image forming apparatus in which the problems described above are eliminated.

Another and more specific object of the present invention to provide an image forming apparatus which can record images of a high quality at a high speed.

Still another object of he present invention is to provide an image forming apparatus comprising a plurality of process units contacting a continuous recording medium and transferring images on the recording medium, separating and contacting means for controlling at least one of the recording medium and each of the process units to a separated state where the recording medium and the process unit are separated from each other and a contacting state where the recording medium and the process unit contact each other, and control means for controlling the separating and contacting means at a position where the process unit confronts a non-printing region on the recording medium so as to put the recording medium and the process unit to the contacting state. According to the image forming apparatus of the present invention, it is possible to prevent the image which is not yet fixed on the recording medium from being disturbed when the back-feed is carried out with respect to the recording medium. As a result, it is possible to prevent deterioration of the image recording quality, and to carry out the image recording at a high speed.

Other objects and further features of the present invention will be apparent from the following detailed description when read in conjunction with the accompanying drawings.

BRIEF DESCRIPTION OF THE INVENTION

Figure 3A:
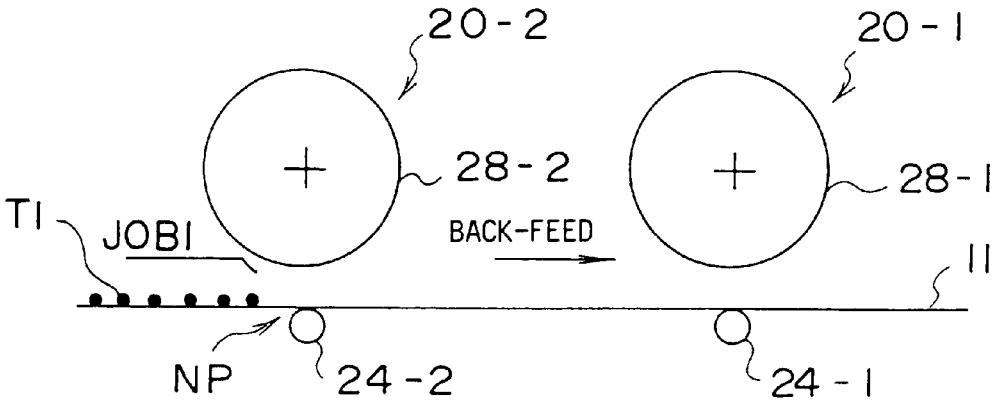
Figure 3B:
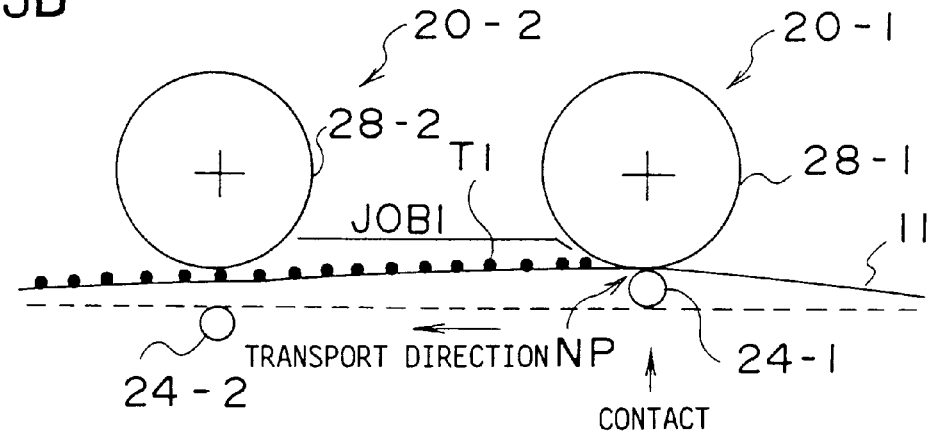
Figure 3C:
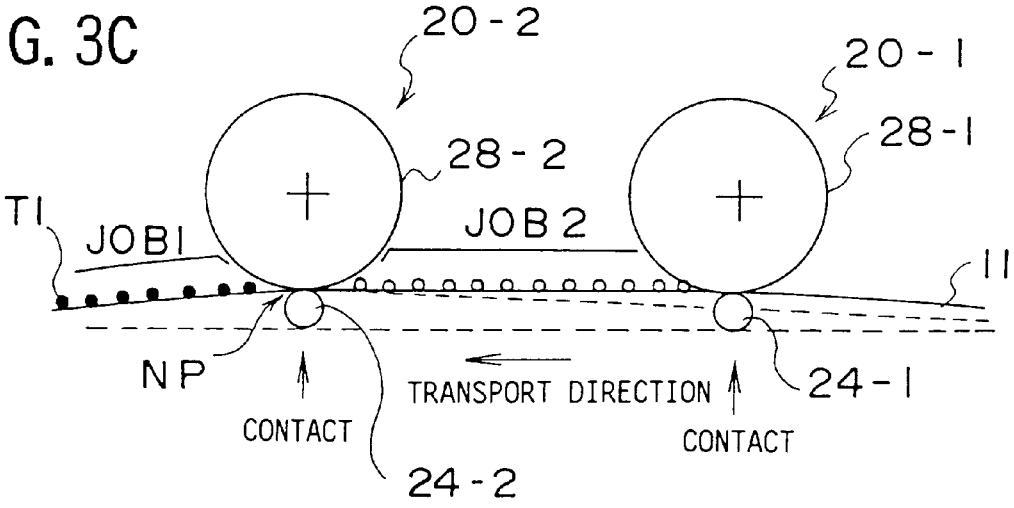
Figure 4:
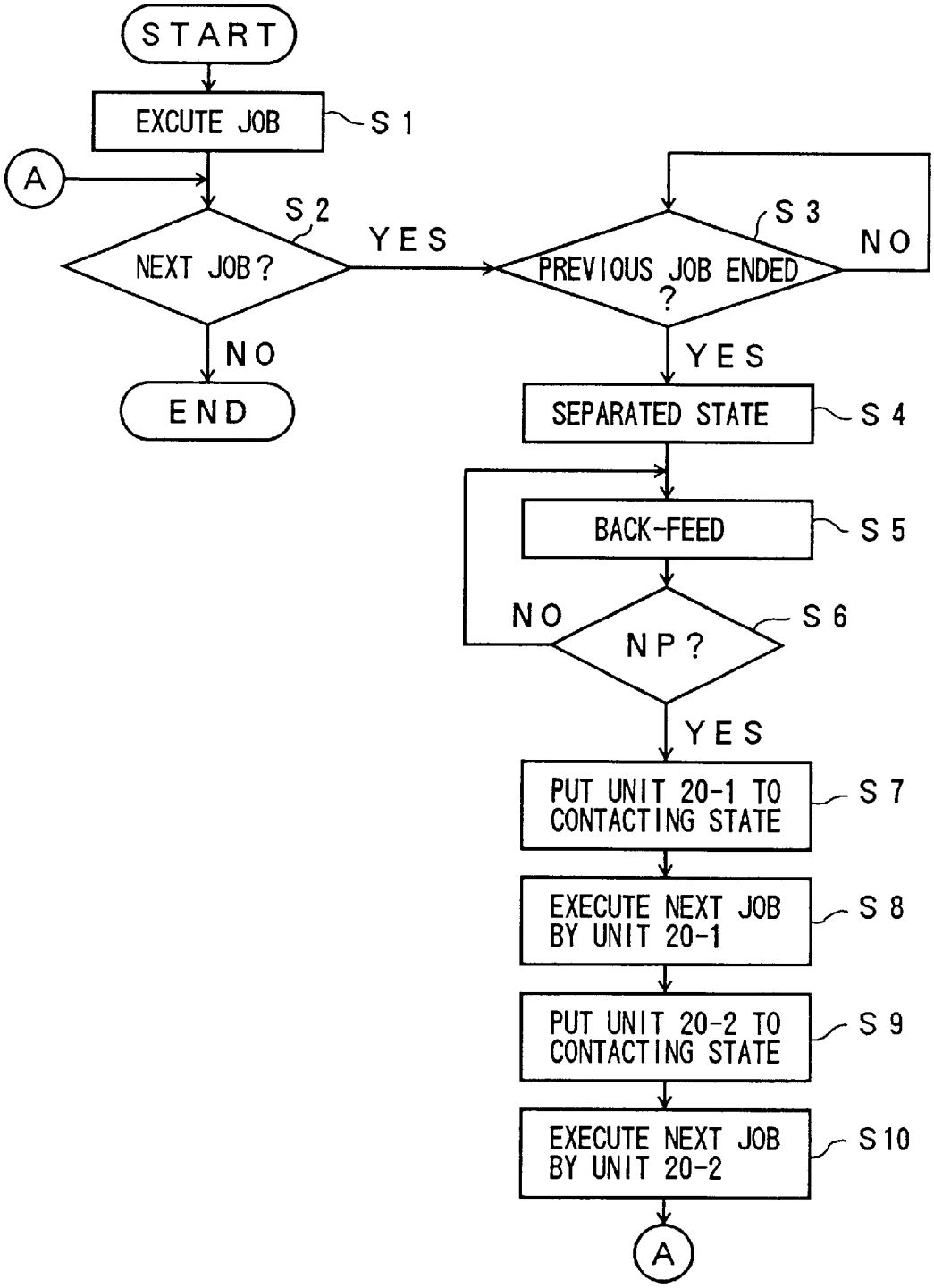
Figure 5:
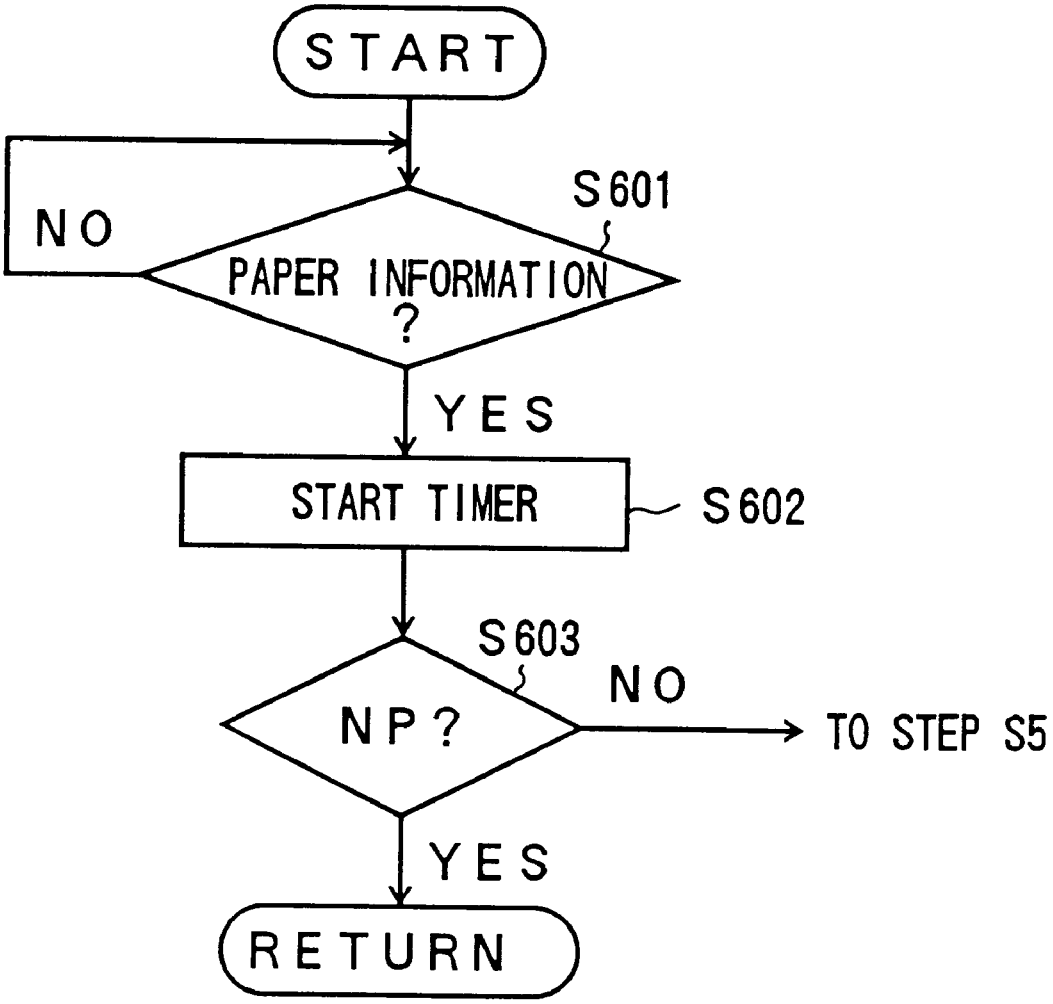
Figure 6:
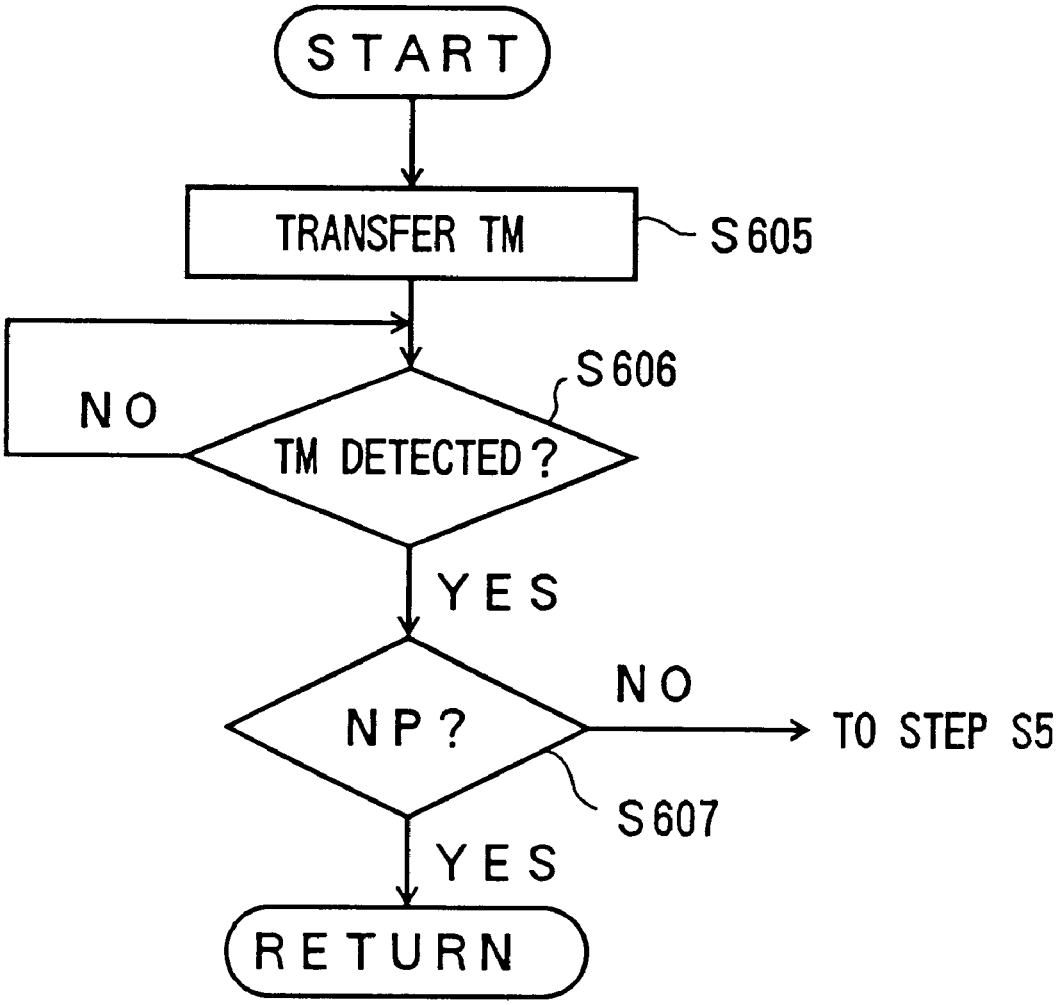
Figure 7:
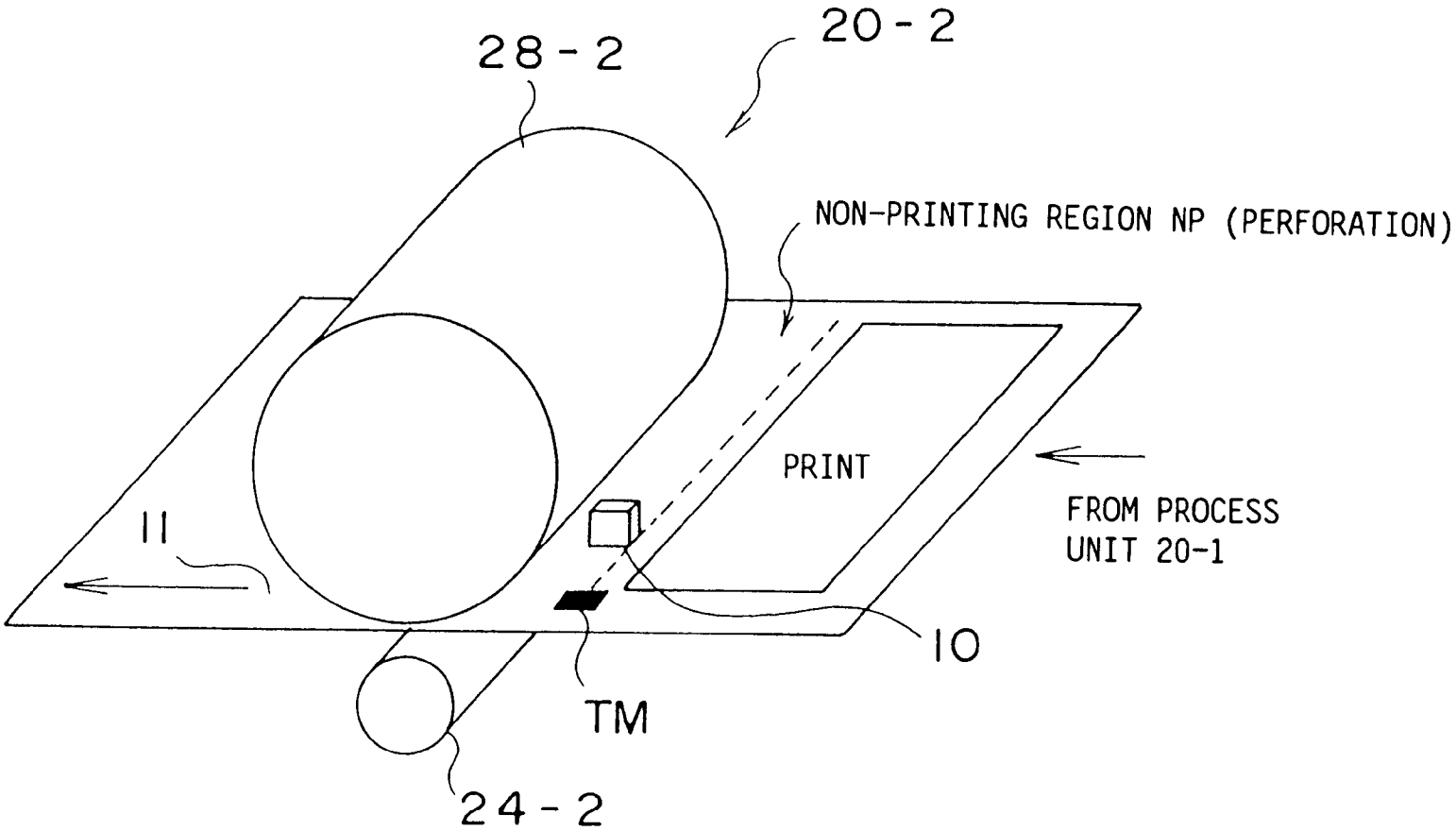
Figure 8:
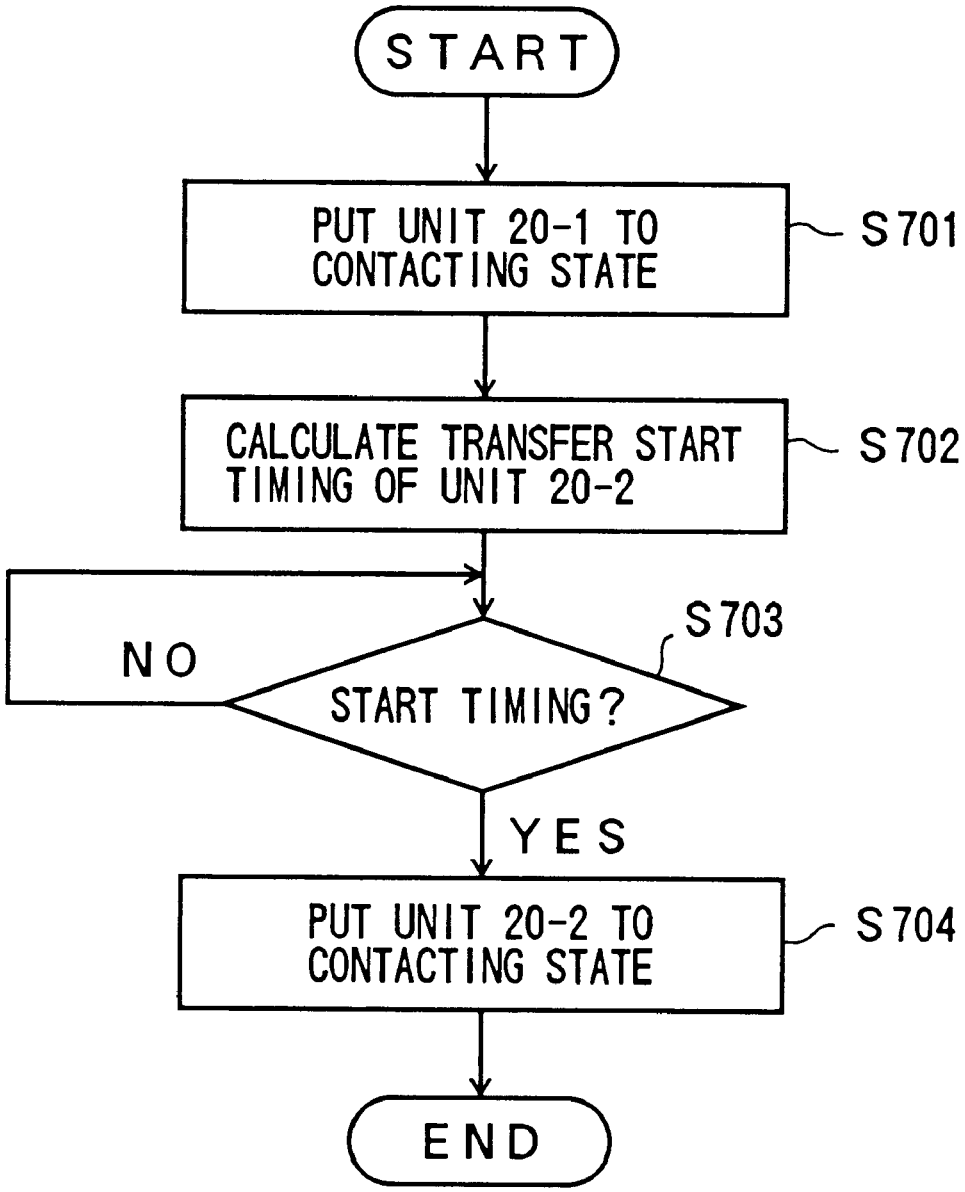
Figure 9A:
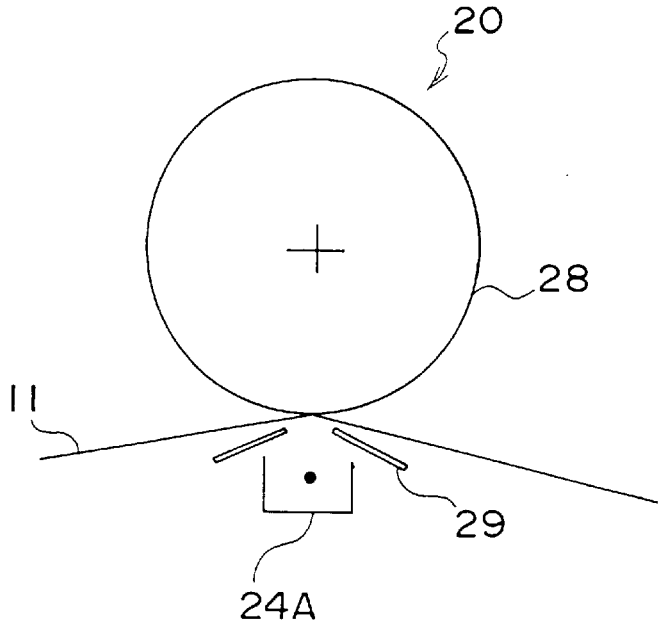
Figure 9B:
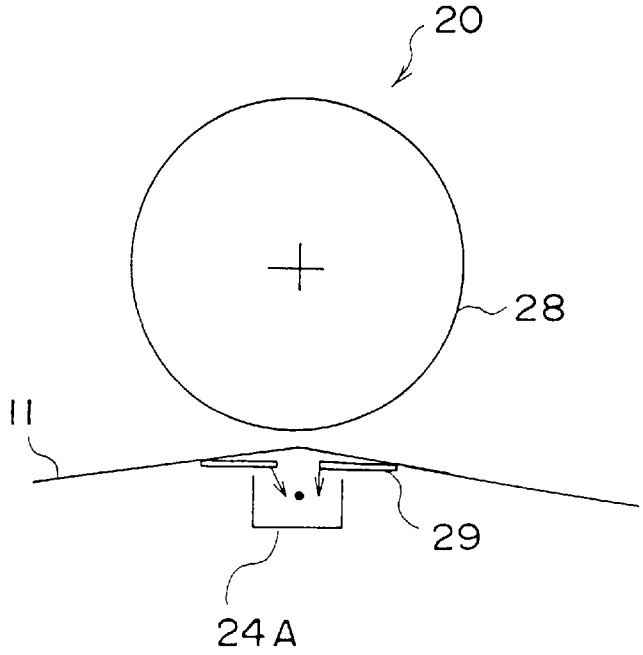
Figure 10:
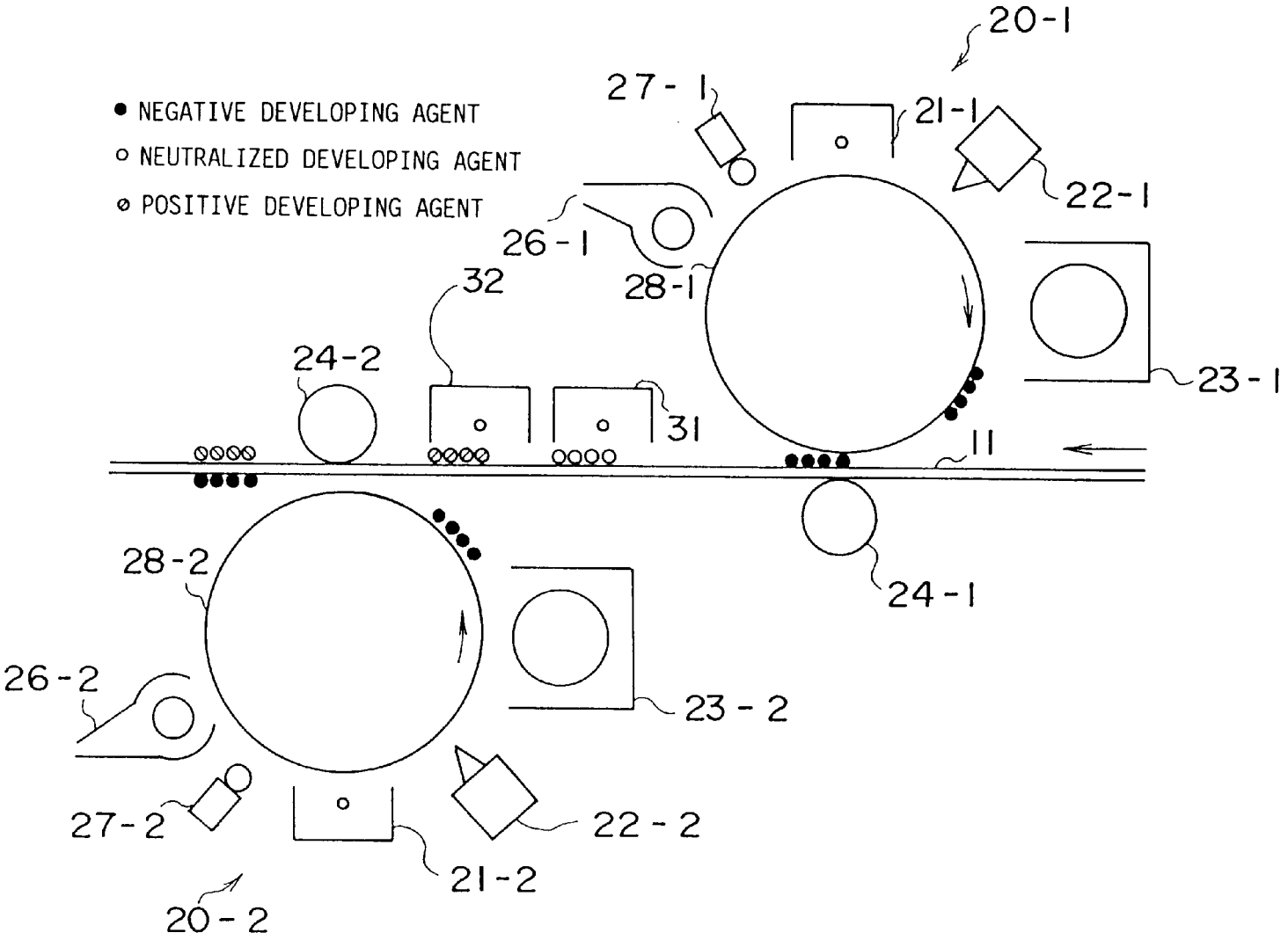
Figure 11:
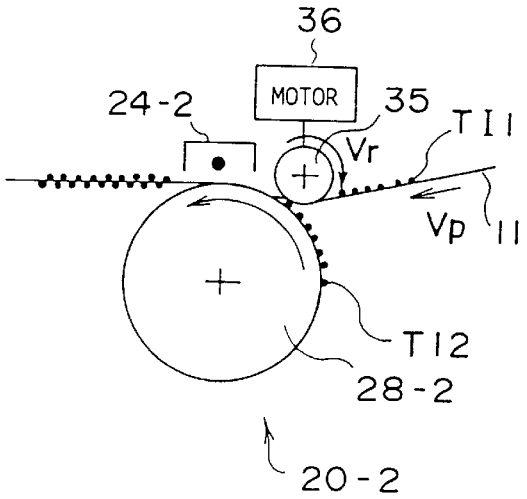
Figure 12:
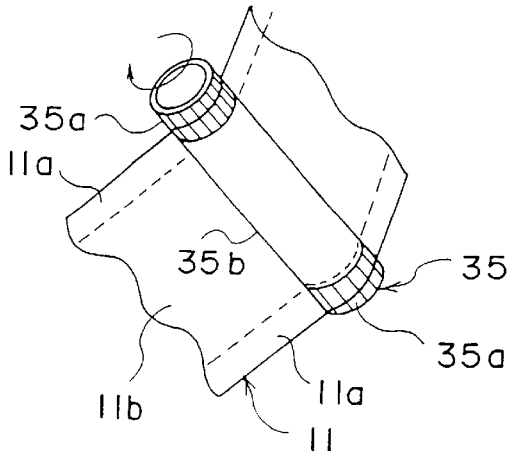
Figure 13:
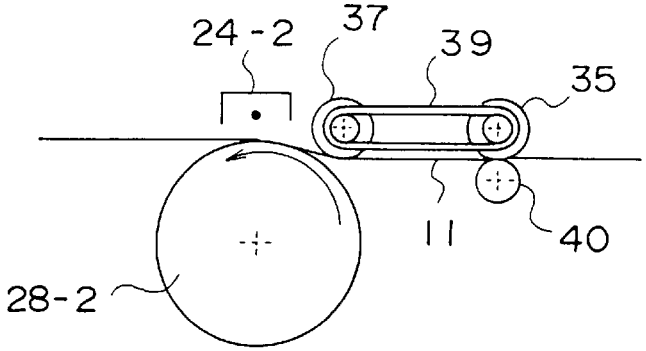
Figure 14:
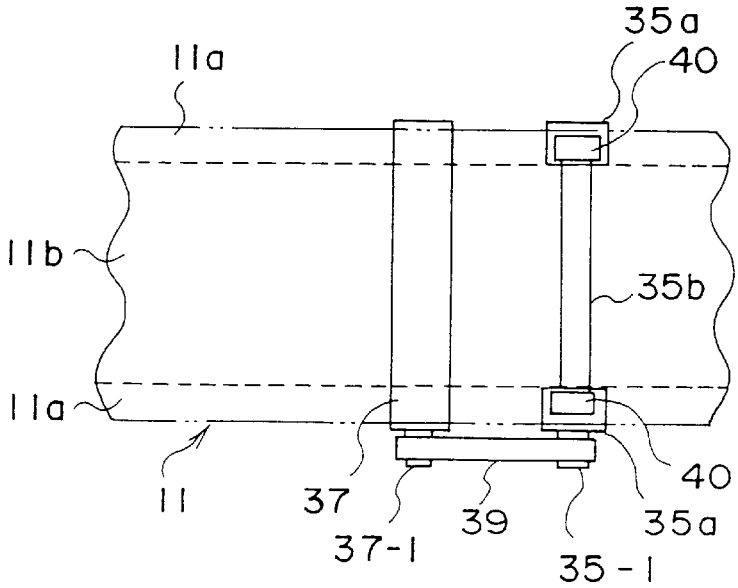
Figure 15:
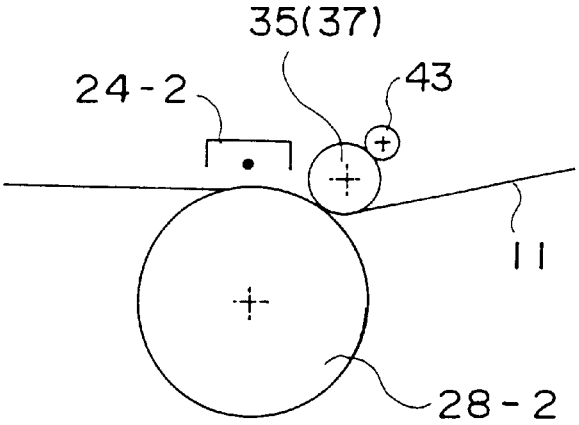
Figure 16:
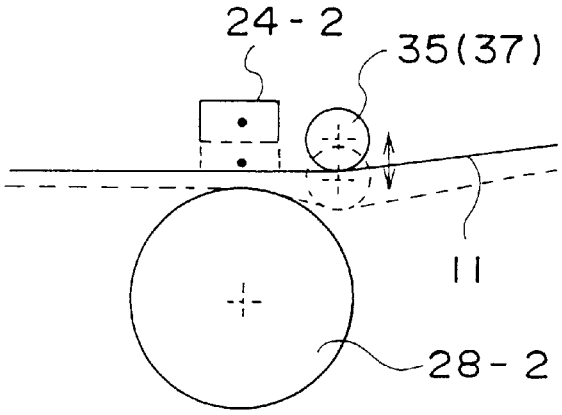
Figure 17:
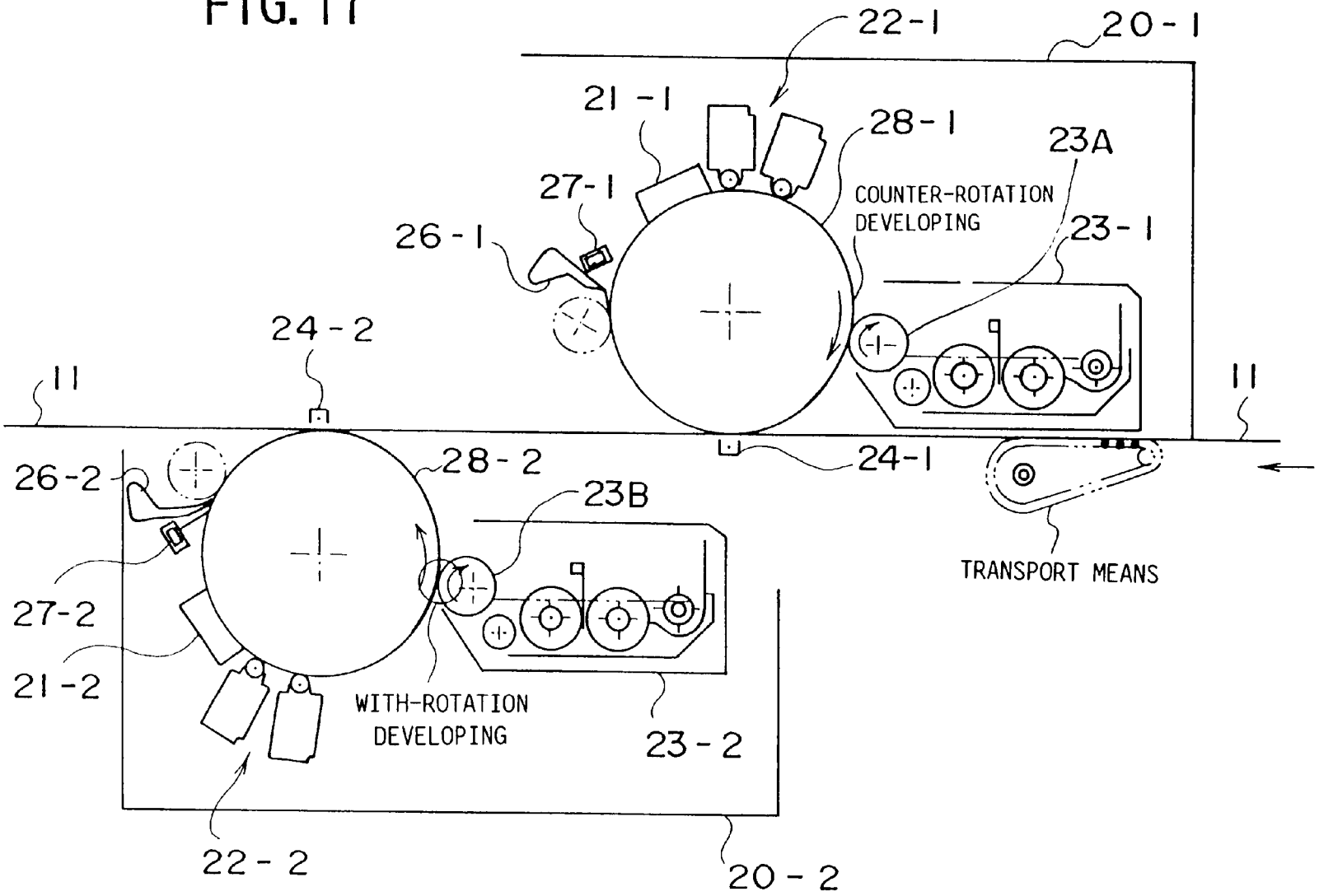

FIGS. 3A, 3B and 3C respectively are diagrams for explaining the print operation of the first embodiment;

FIG. 4 is a flow chart for explaining a separating and contacting mechanism control process of a controller;

FIG. 5 is a flow chart showing an embodiment of a process for a case where information for obtaining a detection result of a non-printing region is input from outside a printer;

FIG. 6 is a flow chart showing an embodiment of a process for a case where information for obtaining the detection result of the non-printing region is input from a sensor;

FIG. 7 is a perspective view showing an arrangement of the sensor;

FIG. 8 is a flow chart showing an embodiment of a process for contacting a photoconductive body of the process unit and a recording paper after a back-feed;

FIGS. 9A and 9B respectively are diagrams showing the construction which separates and contacts the recording paper with respect to each process unit;

FIG. 10 is a diagram showing the general construction of a process part of a second embodiment of the image forming apparatus according to the present invention;

FIG. 11 is a diagram showing the general construction of an important part of the process unit of a third embodiment of the image forming apparatus according to the present invention;

FIG. 12 is a perspective view showing a guide roller shown in FIG. 11;

FIG. 13 is a diagram showing the general construction of an important part of a first modification of the third embodiment;

FIG. 14 is a plan view showing a guide roller part shown in FIG. 13;

FIG. 15 is a diagram showing the general construction of an important part of a second modification of the third embodiment;

FIG. 16 is a diagram showing the general construction of an important part of a third modification of the third embodiment; and FIG. 17 is a diagram showing the general construction of the process part of a fourth embodiment of the image forming apparatus according to the present invention.

DESCRIPTION OF THE PREFERRED EMBODIMENTS

Figure 1:
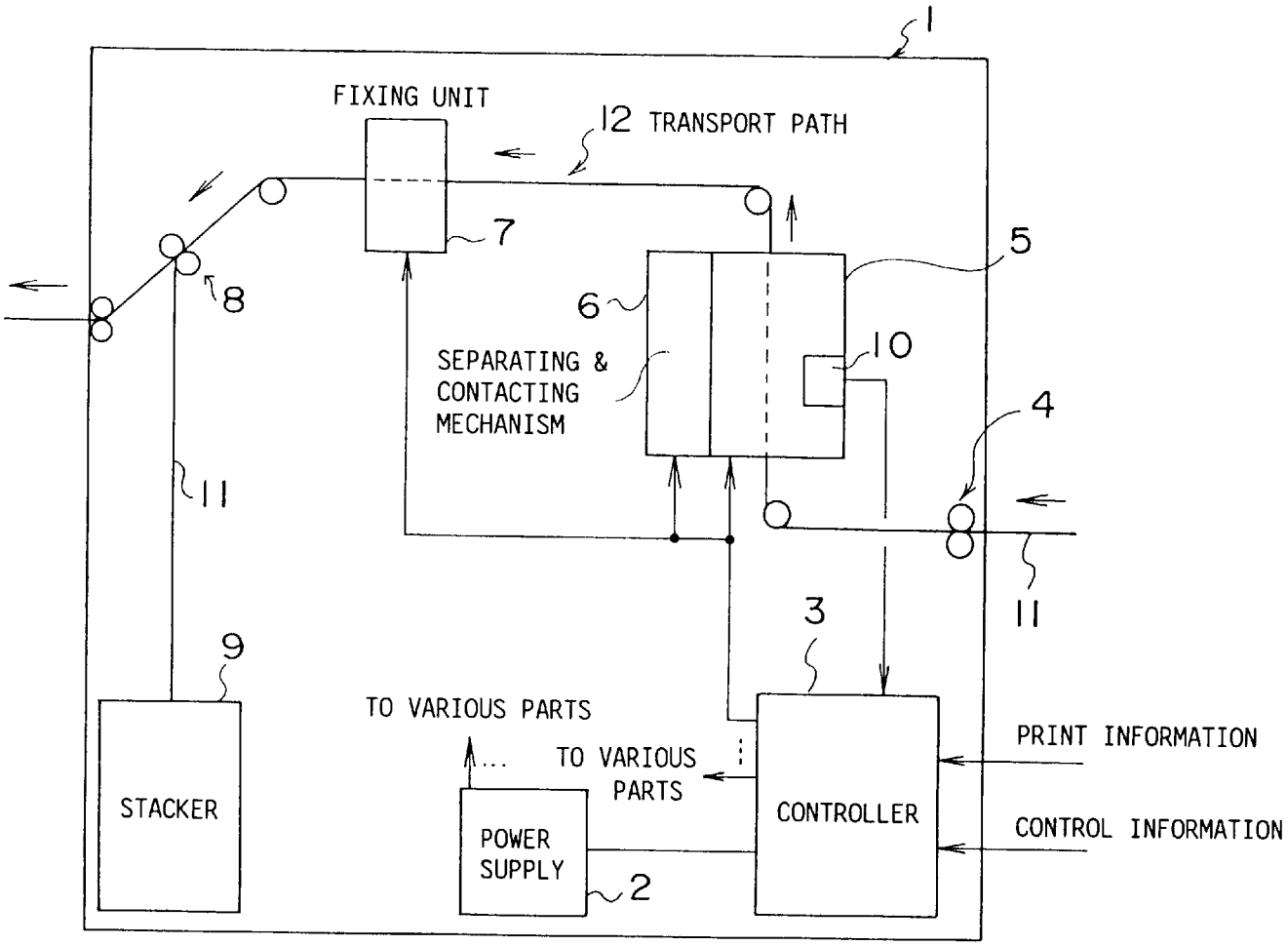
FIG. 1 is a diagram showing the general construction of a first embodiment of an image forming apparatus according to the present invention.

FIG. 1 is a diagram showing the general construction of a first embodiment of an image forming apparatus according to the present invention. In this embodiment, the present invention is applied to a printer using the electrophotography technique.

A printer 1 shown in FIG. 1 generally includes a power supply 2, a controller 3, a paper supply part 4, a process part 5, a separating and contacting mechanism 6, a fixing unit 7, a paper separating part 8, a stacker 9, and a sensor 10. The controller 3 includes a central processing unit (CPU) or the like which controls the entire print operation of the printer 1 by controlling the operations of the various parts within the printer 1 such as the paper supply part 4, the process part 5, the separating and contacting mechanism 6, the fixing unit 7 and the paper separating part 8. The paper supply part 4 receives a continuous recording paper 11 as a recording medium from a pre-processing mechanism (not shown) and supplies the recording paper 11 into the printer 1 by a known means. The pre-processing mechanism may be a so-called hopper, and this hopper may be provided within the printer 1. The recording paper 11 supplied into the printer 1 is transported by a known transport means (not shown) in a transport direction indicated by arrows in FIG. 1 along a predetermined transport path 12 within the printer 1. As will be described later, it is not essential to provide the sensor 10.

The process part 5 includes a plurality of process units which transfer images onto the recording paper 11 using the electrophotography technique under the control of the controller 3. The separating and contacting mechanism 6 includes a solenoid, an air pump or the like, and controls at least one of the recording paper 11 and each of the process units to a separated state where the recording paper 11 and the process unit are separated from each other and a contacting state where the recording paper 11 and the process unit contact each other, under the control of the controller 3. As will be described later, the controller 3 determines the timing with which the separating and contacting mechanism 6 is controlled to the separated state and the contacting state, based on an internal timer, an output signal of the sensor 10 and the like.

Under the control of the controller 3, the fixing unit 7 fixes the image transferred onto the recording paper 11 by making contact with or by not making contact with the recording paper 11. The paper separating part 8 supplies the recording paper 11 recorded with the image to an after-processing mechanism (not shown) or stacks the recording paper 11 recorded with the image on the stacker 9 within the printer 1, under the control of the controller 3. Perforations are formed at predetermined intervals on the recording paper 11, and the recording paper 11 is successively stacked on the stacker 9 by being alternately folded in mutually opposite directions along the perforations.

Figure 2:
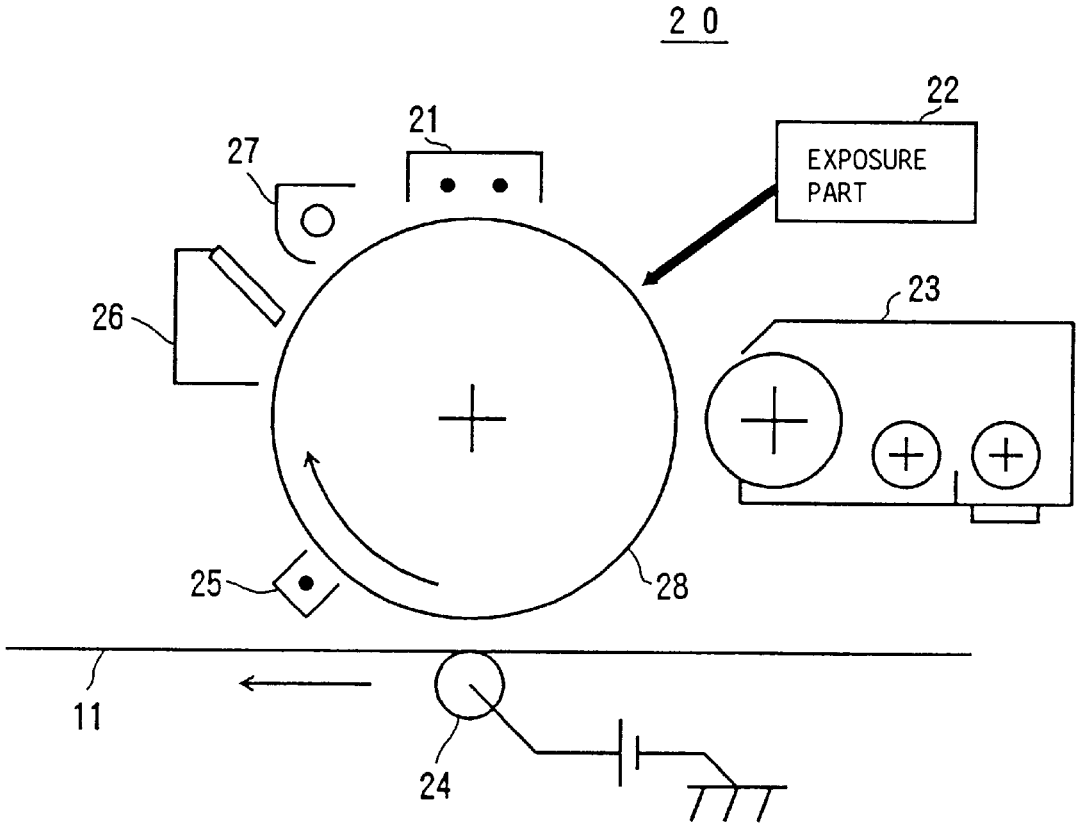
FIG. 2 is a diagram showing an embodiment of a process unit.

FIG. 2 is a diagram showing an embodiment of the process unit. In this embodiment, it is assumed for the sake of convenience that the process part 5 includes two process units each having the construction shown in FIG. 2.

As shown in FIG. 2, a process unit 20 generally includes a precharger 21, an exposure part 22, a developing part 23, a transfer part 24, an AC discharger 25, a cleaner part 26, a light emitting diode (LED) discharger 27, and a photoconductive body 28. In this embodiment, the photoconductive body 28 includes a photoconductive drum. At the time of the printing, the photoconductive body 28 is rotated clockwise by a known means as indicated by an arrow, and the surface of the photoconductive body 28 is uniformly charged by the precharger 21. The exposure part 22 exposes a pattern corresponding to the image which is to be recorded on the recording paper 11 on the surface of the photoconductive body 28, so as to form an electrostatic latent image. This electrostatic latent image is developed into a toner image by the developing part 23.

On the other hand, the recording paper 11 is transported by a known means in a direction indicated by an arrow in FIG. 2. Hence, as the photoconductive body 28 rotates, the toner image is transferred onto the transported recording paper 11 by the transfer part 24. This toner image is fixed by the fixing unit 7 shown in FIG. 1 which is provided at a subsequent stage.

The charge of the residual toner remaining on the surface of the photoconductive body 28 after the toner image is transferred onto the recording paper 11 is eliminated by the AC discharger 25 and is mechanically removed by a cleaning blade or a brush of the cleaner part 26. Thereafter, the LED discharger 27 returns the surface potential of the photoconductive body 28 to the initial stage (for example, 0 V).

FIGS. 3A through 3C respectively are diagrams for explaining the print operation of the first embodiment. In FIGS. 3A through 3C, those parts which are the same as those corresponding parts in FIG. 2 are designated by the same reference numerals, and in addition, parts of a first process unit 20-1 are indicated with a suffix "−1" and parts of a second process unit 20-2 are indicated with a suffix "−2", and a description thereof will be omitted. For the sake of convenience, FIGS. 3A through 3C only show important parts of each of the process units 20-1 and 20-2.

FIG. 3A shows a stage where a first print operation (job) JOB1 ends, a toner image TI is transferred onto the recording paper 11 by the first and second process units 20-1 and 20-2, and under the control of the controller 3, the separating and contacting mechanism 6 controls at least one of the recording paper 11 and each of the process units 20-1 and 20-2 to the separated state where the recording paper 11 and each of the process units 20-1 and 20-2 are separated from each other. When a next second print operation (job) JOB2 is started in this state, the part of the recording paper 11 between the first and second process units 20-1 and 20-2 remains unrecorded, and the utilization efficiency of the recording paper 11 is poor. Hence, as indicated by an arrow, the back-feed is made to feed the recording paper 11 in a direction opposite to the normal transport direction during the printing. By this back-feed, the recording paper 11 is fed back to a position where a non-printing region NP on the recording paper 11 confronts the photoconductive body 28-1 and the transfer part 24-1 of the first process unit 20-1. Although the toner image TI transferred onto the recording paper 11 by the first job JOB1 is not yet fixed, the photoconductive body 28-1 of the first process unit 20-1 and the surface of the recording paper 11 transferred with the toner image TI are separated from each other, and the toner image TI will not be disturbed by the back-feed. The non-printing region NP is a region on the recording paper 11 where no image is printed, such as a portion provided with the perforation, for example.

The illustration of a transport means for transporting the recording paper 11 in the transport direction during the normal recording and for transporting the recording paper 11 in a direction opposite to the transport direction during the back-feed will be omitted. However, it is of course possible to use a known transport means to make such transport of the recording paper 11.

FIG. 3B shows a state where the back-feed of the recording paper 11 is made as described above, and in order to start the second job JOB2, the separating and contacting mechanism 6, under the control of the controller 3, controls at least one of the recording paper 11 and the first process unit 20-1 to the contacting state where the recording paper 11 and the first process unit 20-1 contact each other. Since the photoconductive body 28-1 of the first process unit 20-1 makes contact with the non-printing region NP on the recording paper 11, the toner image TI will not be disturbed upon contact. The image transfer of the second job JOB2 by the first process unit 20-1 is started in this state.

FIG. 3C shows a state where a predetermined time elapses from the start of the second job JOB2, and in order to start the image transfer by the second process unit, the separating and contacting mechanism 6, under the control of the controller 3, controls at least one of the recording paper 11 and the second process unit 20-2 to the contacting state where the recording paper 11 and the second process unit 20-2 contact each other. The image transfer of the second job JOB2 by the second process unit 20-2 is started in this state.

In the above description, the controller 3 controls the separating and contacting mechanism 6 so that the process unit makes contact with the recording paper 11 in an order starting from the process unit which transfers the image, that is, starting from the process unit provided on the upstream side with respect to the transport direction of the recording paper 11. Particularly when the number of process units is large, the toner image which is not yet fixed on the recording paper 11 may become disturbed when all of the process units simultaneously make contact with the recording paper 11 due to the vibration of the recording paper 11 or the like caused by the shock upon contact. However, when the number of process units is small or the vibration of the recording paper 11 or the like upon contact of the process units and the recording paper 11 can be suppressed, all of the process units may simultaneously make contact with the recording paper 11 or, the process units may be divided into groups each having a plurality of process units and the process units within the same group may simultaneously make contact with the recording paper 11.

Next, a description will be given of the control timing of the separating and contacting mechanism 6 by the controller 3, by referring to FIG. 4. FIG. 4 is a flow chart for explaining a separating and contacting mechanism control process of the controller 3. For the sake of convenience, it is assumed that the jobs JOB1 and JOB2 shown in FIGS. 3A through 3C are carried out.

In FIG. 4, a step S1 executes a job if the job is input to the printer 1 from an external host unit (not shown) or the like in the form of print information and control information. In this case, the job JOB1 is carried out by the first and second process units 20-1 and 20-2. A step S2 decides whether or not the next job is input. The process ends if the decision result in the step S2 is NO, and the process advances to a routine or the like for feeding the recording paper 11 forward. On the other hand, if the decision result in the step S2 is YES, a step S3 decides whether or not the previous job JOB1 has ended.

If the decision result in the step S3 becomes YES, a step S4 controls the separating and contacting mechanism 6, and controls at least one of the recording paper 11 and each of the first and second process units 20-1 and 20-2 to the separated state where the recording paper 11 and each of the first and second process units 20-1 and 20-2 are separated from each other. More particularly, the solenoid, air pump or the like of the separating and contacting mechanism 6 acts on parts which support rotary shafts of the photoconductive bodies 28-1 and 28-2 of the first and second process units 20-1 and 20-2 so as to separate the photoconductive bodies 28-1 and 28-2 from the recording paper 11. A step S5 controls the transport means in this separated state, so as to make the back-feed and feed the recording paper 11 in the direction opposite to the transport direction during the normal recording. A step S6 decides whether or not the photoconductive body 28-1 of the first process unit 20-1 reached a position confronting the non-printing region NP on the recording paper 11 on the upstream side in the transport direction with respect to the last line of the toner image TI transferred on the recording paper 11 by the job JOB1. The process returns to the step S5 if the decision result in the step S6 is NO. The position of the recording paper 11 where the photoconductive body 28-1 confronts the non-printing region NP on the recording paper 11 on the upstream side in the transport direction with respect to the last line of the toner image TI transferred on the recording paper 11 by the job JOB1 can be calculated using a detection result of the non-printing region NP based on a distance between the first and second process units 20-1 and 20-2 or the like.

On the other hand, if the decision result in the step S6 is YES, a step S7 controls the separating and contacting mechanism 6 and controls at least one of the recording paper 11 and the first process unit 20-1 to the contacting state where the recording paper 11 and the first process unit 20-1 contact each other. In addition, a step S8 carries out the next job JOB2 by the first process unit 20-1. When the timing to carry out the job JOB2 by the second process unit 20-2 comes, a step S9 controls the separating and contacting mechanism 6 and controls at least one of the recording paper 11 and the second process unit 20-2 to the contacting state where the recording paper 11 and the second process unit 20-2 to the contacting state where the recording paper 11 and the second process unit 20-2 contact each other. Furthermore, a step S10 carries out the job JOB2 by the second process unit 20-2, and the process returns to the step S2.

FIG. 5 is a flow chart showing an embodiment of the process carried out by the step S6 in a case where information for obtaining the detection result of the non-printing region NP is input from outside the printer 1. In this case, the sensor 10 shown in FIG. 1 can be omitted.

In FIG. 5, a step S601 decides whether or not paper information related to the size or the like of the recording paper 11 is input to the controller 3 by the control information. For example, the paper information is input by the operator from the host unit or, input from an operation panel of the printer 1. Alternatively, if a mechanism is provided to automatically judge the size of the like of the recording paper 11 when the recording paper 11 is set on the printer 1, the paper information may be input automatically to the printer1 from such a mechanism.

If the decision result in the step S601 becomes YES, a step S602 starts an internal timer of the controller 3. Because the perforations of the recording paper 11 are provided periodically, a step S603 calculates the position of the recording paper 11 where the photoconductive body 28-1 confronts the non-printing region NP on the recording paper 11 on the upstream side in the transport direction with respect to the last line of the toner image TI transferred on the recording paper 11 by the job JOB1, and decides whether or not the recording paper 11 is fed back to the calculated position. This calculated position is calculated by the step S603 based on a counted value of the internal timer, the transport quantity and transport direction of the recording paper 11, the distance between the first and second process units 20-1 and 20-2 and the like. If the decision result in the step S603 is YES, the process advances to the step S7 shown in FIG. 4. On the other hand, if the decision result in the step S603 is NO, the process returns to the step S5 shown in FIG. 4.

FIG. 6 is a flow chart showing an embodiment of the process carried out by the step S6 in a case where information for obtaining the detection result of the non-printing region NP is input from the sensor 10.

In FIG. 6, a step S605 transfers a toner mark TM at a perforation portion on the recording paper 11 by the first process unit 20-1 or the second process unit 20-2 in advance, before the back-feed is carried out. Since the perforations of the recording paper 11 are provided periodically, the timing with which the toner mark TM is transferred onto the recording paper 11 can be obtained similarly to the case shown in FIG. 5 described above. A step S606 decides whether or not the output signal of the sensor 10 which indicates the detection of the toner mark TM is received. The location of the sensor 10 is not limited to within the process part 5, but may be provided at any location on the downstream side in the transport direction with respect to the process unit which transfers the toner mark TM at the perforation portion on the recording paper 11.

FIG. 7 is a perspective view showing a case where the toner mark TM is transferred onto the recording paper 11 by the first process unit 20-1, and the sensor 10 is arranged at a position which is on the downstream side of the first process unit 20-1 in the transport direction and on the upstream side of the second process unit 20-2 in the transport direction. For example, the sensor 10 is an optical reading means made up of a charged coupled device (CCD).

If the decision result in the step S606 is YES, a step S607 calculates, based on the output signal of the sensor 10, the position of the recording paper 11 where the photoconductive body 28-1 confronts the non-printing region NP on the recording paper 11 on the upstream side in the transport direction with respect to the last line of the toner image TI transferred on the recording paper 11 by the job JOB1, and decides whether or not the recording paper 11 is fed back to the calculated position. If the decision result in the step S607 is YES, the process advances to the step S7 shown in FIG. 4. On the other hand, if the decision result in the step S607 is NO, the process returns to the step S5 shown in FIG. 4.

FIG. 8 is a flow chart showing an embodiment of the process carried out by the step S7.

In FIG. 8, a step S701 controls the separating and contacting mechanism 6 so that the photoconductive body 28-1 of the first process unit 20-1 and the recording paper 11 assume the contacting state. A step S702 calculates the start timing of the image transfer by the second process unit 20-2 which is arranged on the downstream side in the transport direction, based on the print information of the job JOB2. A step S703 decides whether or not the start timing of the image transfer by the second process unit 20-2 is reached. If the decision result in the step S703 is YES, a step S704 controls the separating and contacting mechanism 6 so that the photoconductive body 28-2 of the second process unit 20-2 and the recording paper 11 assume the contacting state. Thereafter, the process returns to the step S8 shown in FIG. 4.

When moving the recording paper between the contacting state and the separated state with respect to each process unit, it is possible to employ a structure shown in FIGS. 9A and 9B. FIGS. 9A and 9B respectively show the structure which separates and contacts the recording paper with respect to each process unit by driving a paper guide which guides the recording paper by the separating and contacting mechanism. In FIGS. 9A and 9B, those parts which are essentially the same as those corresponding parts in FIG. 2 are designated by the same reference numerals, and a description thereof will be omitted.

FIG. 9A shows a case where the solenoid, air pump or the like of the separating and contacting mechanism 6 is active, a paper guide 29 is pushed in a direction towards the photoconductive body 28 of the process unit 20 by the separating and contacting mechanism 6, and the photoconductive body 28 and the recording paper 11 are in the contacting state. On the other hand, FIG. 9B shows a state where the separating and contacting mechanism 6 is inactive, and the photoconductive body 28 and the recording paper 11 are in the separated state because the paper guide 29 is in a receded position.

In addition, for the sake of convenience, this embodiment is described for the case where two process units are provided, but a similar control may be carried out for cases where more than three process units are provided. It is possible to print in two colors when two process units are provided. Hence, if four process units using yellow toner, magenta toner, cyan toner and black toner are provided, for example, it is possible to print in full color.

Furthermore, this embodiment is described for the case where each of the process units transfer the images onto the same side of the recording paper, however, a plurality of process units may be provided with respect to the first side and the second side of the recording paper. In this case, it is possible to carry out a duplex image printing. In addition, if a sufficient number of process units are provided with respect to the first and second sides of the recording paper, it is possible to carry out the duplex printing in full color.

When the image transfer to the first side of the recording paper is made by the first process unit, the image transfer to the second side of the recording paper is made by the second process unit, and the fixing of the images is finally carried out, the toner image transferred onto the first side of the recording paper by the first process unit contacts the transfer part of the second process unit as this toner image passes the second process unit. The transfer part transfers the toner image onto the recording paper using an electric field opposite to the polarity of the charge of the toner image formed on the surface of the photoconductive body. For this reason, in a case where the polarities of the charges of the toner images formed on the surfaces of the photoconductive bodies of the first and second process units are the same, the toner image which is transferred onto the first side of the recording paper by the first process unit and is not yet fixed is electrostatically attracted by the transfer part of the second process unit. As a result, depending on the amount of the toner attracted to the transfer part of the second process unit, a normal image transfer to the second side of the recording paper may not be carried out due to toner stain on the transfer part, thereby generating a printing defect. Next, a description will be given of a second embodiment of the image forming apparatus according to the present invention which can positively prevent such a printing defect.

The general construction of the second embodiment of the image forming apparatus is basically the same as the construction of the first embodiment shown in FIG. 1, and an illustration thereof will be omitted. In this second embodiment, the process part has a construction shown in FIG. 10.

FIG. 10 is a diagram showing the general construction of the process part 5 of the second embodiment. In FIG. 10, those parts which are essentially the same as those corresponding parts in FIGS. 2 and 3 are designated by the same reference numerals, and a description thereof will be omitted. In addition, in FIG. 10, a developing agent having the charge of negative polarity is indicated by a black circular mark, a developing agent having the charge of positive polarity is indicated by a white circular mark with hatching, and a neutralized developing agent is indicated by a white circular mark.

In FIG. 10, the surface of the first photoconductive body 28-1 is charged to approximately −600 V, for example, by the first charger 21-1 which is applied with a DC voltage of −7 kV, for example, and the electrostatic latent image is exposed by the first exposure part 22-1. A 2-component developing agent made up of a positive charge carrier and a negative charge toner is provided in the first developing part 23-1, and the electrostatic latent image is visualized by the negative charge toner, thereby forming the negative charge toner image on the surface of the first photoconductive body 28-1. The first transfer part 24-1 which is applied with a DC voltage of +500 V, for example, electrostatically attracts the negative charge toner image, and transfers the toner image onto the first side of the recording paper 11.

Next, the negative charge toner image on the first side of the recording paper 11 is charged by first and second reverse chargers 31 and 32 before reaching the second process unit 20-2 on the downstream side in the transport direction of the recording paper 11. In other words, the negative charge toner image (developing agent) on the first side of the recording paper 11 is charged by an opposite polarity by the first reverse charger 31 which is applied with an AC voltage of 12 kV, for example, thereby neutralizing the negative charge toner image on the first side. Furthermore, the neutralized toner image (developing agent) on the first side of the recording paper 11 is charged with an opposite polarity by the second reverse charger 32 which is applied with a DC voltage of +6 kV, for example, thereby charging the neutralized toner image on the first side into a positive charge toner image.

Accordingly, when the negative charge toner image formed on the surface of the second photoconductive body 28-2 of the second process unit 20-2 is electrostatically attracted by the second transfer part 24-2 which is applied with a DC voltage of +500 V, for example, and is transferred onto the second side of the recording paper 11, similarly as in the first process unit 20-1 described above, the positive charge toner image existing on the first side of the recording paper 11 will not be attracted to the second transfer part 24-2 because the positive charge toner image has the same polarity as the positive electric field of the second transfer part 24-2 and repels against the second transfer part 24-2. For this reason, the toner (developing agent) which is transferred onto the first side of the recording paper 11 and is not yet fixed is positively prevented from adhering onto the second transfer part 24-2 and generating the printing defect.

The polarities of the charged toner images transferred onto the first and second sides of the recording paper 11 by the first and second process units 20-1 and 20-2 may of course be opposite to that described above.

In addition, instead of using the first and second reverse chargers 31 and 32, it is possible to provide a single reverse charger and similarly charge the toner image with the opposite polarity.

Furthermore, in the first and second process units 20-1 and 20-2, more particularly, in the first and second developing parts 23-1 and 23-2, it is possible to obtain effects similar to the above by using a developing agent having different charge characteristics, that is, opposite polarities. In this case, the first and second reverse chargers 31 and 32 can be omitted, but on the other hand, not all of the parts such as the developing part can be used in common for both the first and second process units 20-1 and 20-2.

At the upstream side of each process unit in the transport direction of the recording paper, the recorded image is disturbed and the image quality deteriorates if the recording paper slips and a positional error or vibration is generated when the recording paper makes contact with the photoconductive body. Hence, it is conceivable to provide a guide roller for guiding the recording paper to the upstream side of the process unit, in order to stably supply the recording paper to the process unit. However, particularly in the case of a multi-color printing or a duplex printing, the guide roller will make direct contact with the toner image which is already transferred onto the recording paper but is not yet fixed, and the recorded image will be disturbed upon the direct contact. Hence, a description will now be given of a third embodiment of the image forming apparatus according to the present invention which can stably supply the recording paper to the process unit without generating such an image disturbance.

The general construction of the third embodiment of the image forming apparatus is basically the same as the construction of the first embodiment shown in FIG. 1, and an illustration thereof will be omitted. In this third embodiment, the process part has a construction shown in FIG. 11.

FIG. 11 is a diagram showing the general construction of an important part of the process unit of the third embodiment. In FIG. 11, those parts which are the same as those corresponding parts in FIG. 10 are designated by the same reference numerals, and a description thereof will be omitted. In FIG. 11, TI1 indicates a toner image which is transferred onto the first side of the recording paper 11 and is not yet fixed, and TI2 indicates a toner image formed on the surface of the second photoconductive body 28-2.

As shown in FIG. 11, a guide roller 35 for guiding the recording paper 11 is provided on the upstream side of the second photoconductive body 28-2 of the second process unit 20-2. This guide roller 35 is rotated at a speed vr which is approximately the same as a transport speed vp of the recording paper 11 which is transported by the transport means. The guide roller 35 may be rotated by a driving source (motor) 36 which may be the same as or different from a driving source which rotates the second photoconductive body 28-2. Hence, at the upstream side of the second process unit 20-2 where the recording paper 11 makes contact with the second photoconductive body 28-2, the recording paper 11 is stably supplied without slipping. The guide roller 35 may be provided movable with respect to the second photoconductive body 28-2 by the separating and contacting mechanism 6, so that the guide roller 35 is separated from or makes contact with the second photoconductive body 28-2 via the recording paper 11.

FIG. 12 is a perspective view showing the guide roller 35 viewed from below. The guide roller 35 is made of an aluminum core having a silicon rubber layer formed thereon, and a fluoroplastic or fluorine rubber is further coated on the silicon rubber layer. Both end portions 35*a* of the guide roller 35 has an outer diameter slightly larger than that of a central portion 35*b*. The end portions 35*a* of the guide roller 35 make contact with non-printing portions 11*a* of the recording paper 11, and the central portion 35*b* confronts the printed portion on the recording paper 11. For example, the frictional coefficient of the fluoroplastic or fluorine rubber is 0.2, and Mueller bars which are high-friction members having a frictional coefficient of 1.0 to 2.0 are formed on the end portions 35*a* of the guide roller 35. For example, the outer diameter of the end portions 35*a* is 20.2 mm, and the outer diameter of the central portion 35*b* is 20.0 mm.

When the transport speed vp of the recording paper is 250 mm/sec, for example, it was confirmed through experiments conducted by the present inventors that the error of the peripheral speed vr of the guide roller 35 with respect to the transport speed vp can be suppressed within ±5% by rotating the guide roller 35 by the motor 36. Hence, the recording paper 11 is stably supplied to the second process unit 20-2, and the toner image TI1 which is transferred onto the first side of the recording paper 11 and is not yet fixed uneasily makes contact with the guide roller 35 due to the structure of the guide roller 35. As a result, the disturbance to the toner image TI1 which is not yet fixed is suppressed to an extremely small extent.

Of course, instead of driving the guide roller 35 by the motor 36, it is possible to rotate the guide roller 35 by the second photoconductive body 28-2 to rotate therewith. In this case, in a case where the transport speed vp of the recording paper 11 is 250 mm/sec, for example, under the same conditions described above, it was confirmed through experiments conducted by the present inventors that the error of the peripheral speed vr of the guide roller 35 with respect to the transport speed vp can be suppressed within ±10% by rotating the guide roller 35 by the second photoconductive body 28-2 to rotate therewith.

The end portion 35*a* which has the diameter slightly larger than that of the central portion 35*b* may be provided only at one end of the guide roller 35.

FIG. 13 is a diagram showing the general construction of an important part of a first modification of the third embodiment. In addition, FIG. 14 is a plan view showing a guide roller part shown in FIG. 13. In FIGS. 13 and 14, those parts which are the same as those corresponding parts in FIGS. 11 and 12 are designated by the same reference numerals, and a description thereof will be omitted.

In this modification, another guide roller 37 is provided between the guide roller 35 and the photoconductive body 28-2. A belt 39 is provided across a pulley 35-1 which is provided on one end of the guide roller 35 and a pulley 37-1 provided on one end of the guide roller 37. In addition, a roller 40 pushes against both end portions 35*a* of the guide roller 35 via the recording paper 11. The guide rollers 35 and 37 and the roller 40 may be rotated by rotating the guide roller 37 by the second photoconductive body 28-2 to rotate therewith or, at least one of the guide rollers 35 and 37 and the roller 40 may be driven by a driving source such as the motor 36. Further, the outer peripheral surface of the guide roller 37 may have the same outer diameter, but preferably, the guide roller 37 has the same construction as the guide roller 35.

According to this modification, it was confirmed through experiments conducted by the present inventors that it is possible to obtain effects similar to those obtainable in the third embodiment under the same conditions described above.

FIG. 15 is a diagram showing the general construction of an important part of a second modification of the third embodiment. In FIG. 15, those parts which are the same as those corresponding parts in FIGS. 11 and 13 are designated by the same reference numerals, and a description thereof will be omitted.

In this modification, a cleaning roller 43 made of a felt material is provided with respect to the guide roller 35 of the third embodiment or the guide roller 37 of the first modification of the third embodiment. This cleaning roller 43 is constructed to be rotated by the guide roller 35 or 37 to rotate therewith. Hence, even if the toner which is not yet fixed on the recording paper 11 slightly adheres on the guide roller 35 or 37, this toner is cleaned by the cleaning roller 43. Therefore, it is possible to positively prevent the toner image which is not yet fixed from being disturbed by the guide roller 35 or 37.

According to this modification, it was confirmed through experiments conducted by the present inventors under the same conditions described above that, if the transport speed vp of the recording paper 11 is 250 mm/sec, for example, it is possible to suppress the error of the peripheral speed vr of the guide roller 35 or 37 with respect to the transport speed vp to within ±8% even when the cleaning roller 43 is rotated by the guide roller 35 or 37 which is driven by the motor 36 to rotate with the guide roller 35 or 37.

FIG. 16 is a diagram showing the general construction of an important part of a third modification of the third embodiment. In FIG. 16, those parts which are the same as those corresponding parts in FIGS. 11 and 13 are designated by the same reference numerals, and a description thereof will be omitted.

In this modification, the recording paper 11 is moved by the separating and contacting mechanism 6, for example, so as to separate from and make contact with the second photoconductive body 28-2. The guide roller 35 or 37 is arranged so that the recording paper 11 is wound around the guide roller 35 or 37 for an angular range of 10° or greater in the contacting state where the recording paper 11 and the second photoconductive body 28-2 make contact with each other. Hence, it is possible to prevent rubbing and slipping of the recording paper 11 when the recording paper 11 and the guide roller 35 or 37 separate from and make contact with each other, thereby more positively preventing the toner image which is not yet fixed from becoming disturbed. On the other hand, in the case where the second photoconductive body 28-2 is moved by the separating and contacting mechanism 6 to separate from and make contact with the recording paper 11, the guide roller 35 or 37 may be arranged so that the recording paper 11 is wound around the guide roller 35 or 37 for an angular range of 10° or greater in the contacting state where the recording paper 11 and the second photoconductive body 28-2 make contact with each other.

When using a plurality of process units, such as when making a multi-color printing, the process units may have the same construction when the process units transfer the images with respect to the same side of the recording paper. Basically, it is possible to cope with the multi-color printing by simply using different developing agents in the developing parts of the process units. For this reason, it is possible to reduce the number of kinds of parts and to minimize the cost of the printer as a whole. However, when making the duplex printing using a plurality of process units, such as when two process units are provided, the two process units transfer the images with respect to mutually different sides of the recording paper, and the constructions of the two process units are different in this case.

Even in the above described case where the constructions of the two process units are different, parts including the charger, the exposure part, the transfer part, the cleaner part, the discharger part and the photoconductive body simply need to be arranged symmetrically with respect to the transport path of the recording paper between the two process units. Accordingly, the same parts may be used for the two process units with respect to such parts. However, with regard to the developing part, the rotating direction of the developing roller within the developing part is opposite between the two process units, and the same developing part cannot be used for the two process units. For this reason, it is necessary to design and manufacture the developing part with respect to each of the two process units. Next, a description will be given of an embodiment which also enables the same developing part to be used between two process units.

FIG. 17 is a diagram showing the general construction of the process part of a fourth embodiment of the image forming apparatus according to the present invention. In FIG. 17, those parts which are the same as those corresponding parts in FIG. 10 are designated by the same reference numerals, and a description thereof will be omitted.

In FIG. 17, the developing parts 23-1 and 23-2 themselves have known constructions which are the same, respectively including developing rolls 23A and 23B, and a description related to the construction of the developing parts 23-1 and 23-2 themselves will be omitted. This embodiment is characterized by the setting of the rotational directions of the developing rolls 23A and 23B with respect to the rotational directions of the corresponding photoconductive bodies 28-1 and 28-2. More particularly, in the first process unit 20-1, the photoconductive body 28-1 and the developing roll 23A both rotate in the clockwise direction. On the other hand, in the second process unit 20-2, the photoconductive body 28-2 rotates in the counterclockwise direction and the developing roll 23B rotates in the clockwise direction, that is, the photoconductive body 28-2 and the developing roll 23B rotate in mutually opposite directions. Accordingly, the first process unit 20-1 develops the toner image on the photoconductive body 28-1 using the so-called counter-rotation developing wherein the photoconductive body 28-1 and the developing roll 23A rotate counter to each other at the contact point, and the second process unit 20-2 develops the toner image on the photoconductive body 28-2 using the so-called with-rotation developing wherein the photoconductive body 28-2 and the developing roll 23B rotate with each other at the contact point. Hence, according to this embodiment, the parts forming the process units can be used in common for both the two process units 20-1 and 20-2, including the developing part. Therefore, it is possible to reduce the number of kinds of parts and minimize the cost of the printer as a whole.

The developing capability slightly differs between the developing of the toner image using the counter-rotation developing and the developing of the toner image using the with-rotation developing. Thus, in order to make the quality of the image recording approximately the same with respect to both sides of the recording paper 11, at least one of the following methods should be employed.

According to a first method, the rotational speeds of the developing rolls 23A and 23B within the developing parts 23-1 and 23-2 of the first and second process units 20-1 and 20-2 are set to different values. For example, if the outer diameters of the photoconductive bodies 28-1 and 28-2 are 100 mm and the peripheral speeds thereof are 300 mm/sec, and the outer diameters of the developing rolls 23A and 23B are 40 mm, the peripheral speed of the developing roll 23A is set to 600 mm/sec and the peripheral speed of the developing roll 23B is set to 700 mm/sec. As a result, it is possible to make the developing capabilities of the developing parts 23-1 and 23-2 approximately the same.

According to a second method, the toner concentration used in the developing part 23-2 within the second process unit 20-2 which uses the with-rotation developing is set higher than the toner concentration used in the developing part 23-1 within the first process unit 20-1 which uses the counter-rotation developing. For example, the toner concentration used in the developing part 23-1 is set to 4%, and the toner concentration used in the developing part 23-2 is set to 5%. As a result, it is possible to make the developing capabilities of the developing parts 23-1 and 23-2 approximately the same.

According to a third method, the carrier grain diameter used in the part 23-2 within the second process unit 20-2 which uses the with-rotation developing is set smaller than the carrier grain diameter used in the developing part 23-1 within the first process unit 20-1 which uses the counter-rotation developing. For example, the carrier grain diameter used in the developing part 23-1 is set to 80 $\mu$m, and the carrier grain diameter used in the developing part 23-2 is set to 60.5 $\mu$m. As a result, it is possible to make the developing capabilities of the developing parts 23-1 and 23-2 approximately the same.

According to a fourth method, the developing bias used in the developing part 23-2 within the second process unit 20-2 which uses the with-rotation developing is set higher than the developing bias used in the developing part 23-1 within the first process unit 20-1 which uses the counter-rotation developing. For example, the developing bias used in the developing part 23-1 is set to 300 V, and the developing bias used in the developing part 23-2 is set to 350 V. As a result, it is possible to make the developing capabilities of the developing parts 23-1 and 23-2 approximately the same.

Of course, it is possible to use the with-rotation developing in the first process unit 20-1 and to use the counter-rotation developing in the second process unit 20-2.

In addition, in order to facilitate the maintenance of the printer, it is desirable to construct the process units so that the parts of each process unit requiring maintenance face the same side of the printer. By taking such measures, the maintenance of the printer is facilitated, and it is possible to considerably reduce the time required to repair or replace the parts of the printer.

Moreover, the plurality of process units may be arranged vertically in FIG. 1, arranged horizontally depending on the transport path or, arranged in a combination having one or more process units arranged vertically and one or more process units arranged horizontally. Of course, the process units may be arranged obliquely to the vertical direction depending on the arrangement of the transport path and the various parts within the image forming apparatus.

Further, the present invention is not limited to these embodiments, but various variations and modifications may be made without departing from the scope of the present invention.

What is claimed is:

1. An image forming apparatus comprising:

a plurality of process units contacting a continuous recording medium and transferring images onto the recording medium;

separating and contacting means for controlling at least one of the recording medium and each of said process units to a separated state where the recording medium and the process unit are separated from each other and a contacting state where the recording medium and the process unit contact each other; and control means for controlling said separating and contacting means to put the recording medium and said process units into the separated state after said process units transferred an image onto the recording medium, controlling back-feeding of the continuous recording medium so that the beginning of a non-printing region on the continuous recording medium confronts an upstream process unit of said process units, and controlling said separating and contacting means to put the recording medium and the process unit confronting the beginning of the non-printing region on the continuous recording medium into the contacting state.

2. The image forming apparatus as claimed in claim 1, wherein said control means controls said separating and contacting means so that said process units assume the contacting state in an order starting from the process unit provided on an upstream side with respect to a transport direction of the recording medium for transferring images onto the recording medium.

3. The image forming apparatus as claimed in claim 1, wherein said control means controls said separating and contacting means so that a process unit in an OFF state assumes the separated state with respect to the recording medium.

4. The image forming apparatus as claimed in claim 1, wherein each of said process units includes a photoconductive body and a transfer body pushing the recording medium against the photoconductive body, and which further comprises:

means for starting at least one of rotational drive and discharge of the transfer body before said separating and contacting means controls the photoconductive body to the contacting state with respect to the recording medium.

5. The image forming apparatus as claimed in claim 1, wherein the recording medium is a continuous recording paper having a perforation, and the non-printing region includes the perforation.

6. The image forming apparatus as claimed in claim 1, wherein said control means includes:

means for controlling said process units so as to record marks for confirming the non-printing region on the recording medium; and, means for detecting the non-printing region on the recording medium by detecting the marks.

7. The image forming apparatus as claimed in claim 1, wherein said process units include a first process unit recording an image with respect to a first side of the recording medium, and a second process unit recording an image with respect to a second side opposite to the first side of the recording medium, and developing agents of said first and second process units on the recording medium have charges of mutually opposite polarities.

8. The image forming apparatus as claimed in claim 1, which further comprises:

a single fixing means, provided on a downstream side of all of said process units with respect to a transport direction of the recording medium, for fixing the images on the recording medium.

9. The image forming apparatus comprising:

a plurality of process units contacting a continuous recording medium and transferring images onto the recording medium, said process units include a first process unit recording an image with respect to a first side of the recording medium, and a second process unit recording an image with respect to a second side opposite to the first side of the recording medium, and developing agents of said first and second process units on the recording medium have charges of mutually opposite polarities;

separating and contacting means for controlling at least one of the recording medium and each of said process units to a separated state where the recording medium and the process unit are separated from each other and a contacting state where the recording medium and the process unit contact each other;

control means for controlling said separating and contacting means at a position where the process unit confronts a non-printing region on the recording medium so as to put the recording medium and the process unit to the contacting state; and charging means for reversing the polarity of the charge of the developing agent of said first process unit on the recording medium.

10. The image forming apparatus comprising:

a plurality of process units contacting a continuous recording medium and transferring images onto the recording medium;

separating and contacting means for controlling at least one of the recording medium and each of said process units to a separated state where the recording medium and the process unit are separated from each other and a contacting state where the recording medium and the process unit contact each other; and control means for controlling said separating and contacting means at a position where the process unit confronts a non-printing region on the recording medium so as to put the recording medium and the process unit to the contacting state, wherein at least one of said process units includes:

a photoconductive body;

a transfer body pushing the recording medium against the photoconductive body;

a guide roller, provided in a vicinity of and on an upstream side of the transfer body with respect to a transport direction of the recording medium, guiding the non-printing portion on the recording medium; and means for controlling the recording medium and the guide roller to approximately the same speed in a vicinity of the transfer body.

11. The image forming apparatus comprising:

a plurality of process units contacting a continuous recording medium and transferring images onto the recording medium;

separating and contacting means for controlling at least one of the recording medium and each of said process units to a separated state where the recording medium and the process unit are separated from each other and a contacting state where the recording medium and the process unit contact each other; and control means for controlling said separating and contacting means at a position where the process unit confronts a non-printing region on the recording medium so as to put the recording medium and the process unit to the contacting state, wherein said process units include a first process unit recording an image with respect to a first side of the recording medium, and a second process unit recording an image on a second side opposite to the first side of the recording medium, said first and second process units having the same construction including a photoconductive body and a developing body, the photoconductive body and the developing body of said first process unit rotating in the same direction, the photoconductive body and the developing body of said second process unit rotating in opposite directions.

12. The image forming apparatus as claimed in claim 11, wherein the developing body of said first process unit and the developing body of said second process unit rotate at mutually different rotational speeds.

13. The image forming apparatus as claimed in claim 11, wherein said second process unit includes a developing agent having a toner content greater than a toner content of a developing agent included in said first process unit.

14. The image forming apparatus as claimed in claim 11, wherein said first process unit includes a developing agent with a carrier grain diameter different from a carrier grain diameter of a developing agent of said second process unit.

* * * * *